US005605320A

United States Patent [19]

Crawford

[11] Patent Number: 5,605,320

[45] Date of Patent: Feb. 25, 1997

[54] STAPLE REMOVERS

[75] Inventor: Jamieson Crawford, London, England

[73] Assignee: Xerox Corporation, Stamford, Conn.

[21] Appl. No.: 528,825

[22] Filed: Sep. 15, 1995

[30] Foreign Application Priority Data

Jan. 18, 1995 [GB] United Kingdom ..... 9500929

[51] Int. Cl.[6] ..... B25C 11/00

[52] U.S. Cl. ..... 254/28

[58] Field of Search ..... 140/106; 72/409.01; 606/138; 254/28, 18; 29/268

[56] References Cited

U.S. PATENT DOCUMENTS

| | | | |
|---|---|---|---|
| 4,026,520 | 5/1977 | Rothfuss et al. . | |
| 4,589,631 | 5/1986 | Markus | 254/28 |
| 4,805,876 | 2/1989 | Blake et al. | 254/28 |
| 4,903,945 | 2/1990 | Wang . | |
| 5,088,692 | 2/1992 | Weiler . | |
| 5,451,231 | 9/1995 | Rabenau et al. | 254/28 |

FOREIGN PATENT DOCUMENTS 2176434 7/1986 United Kingdom .

*Primary Examiner*—Robert C. Watson

[57] ABSTRACT

A staple remover for extracting a conventional clinched office staple having a central crown portion and two legs extending with arcuate bends from opposite ends of the crown through staple holes in the stapled set of paper sheets, the remover having a first member with two spaced apart prongs inserted between the crown of the staple and the stapled set, and a second member pivotally mounted for movement relative to the first member, and including a nose member moving between and closely adjacent to, but spaced from, the two spaced prongs. The nose member, upon the relative movement between the first and second members, applies staple deformation forces at spaced apart positions adjacent the opposite ends of the crown of the staple, adjacent the clinched staple legs, and adjacent the prongs, on the opposite side of the crown from the prongs, to cause the ends of the crown adjacent the two clinched staple legs to be deformed, without substantial deformation of the central portion of the crown of the staple, so as to allow the two staple legs to be withdrawn substantially through the same staple holes in the paper sheets.

10 Claims, 4 Drawing Sheets

STAPLE REMOVERS

Priority is claimed from UK Application No. GB 9500929.6 filed Jan. 18, 1995, by the same inventor.

This invention relates to staple removers, by which clinched staples may be removed from stapled document sheets. More specifically, the disclosed staple remover provides a document staple remover which is simple and of low cost, yet reduces damage to the flimsy paper sheets from which the staples are removed. It more effectively unclinches and extracts the clinched legs of conventional staples (of the kind typically used for stapling copied or printed paper sheets) back through the holes made in the sheets by those staple legs during stapling.

Known staple removers for removing staples which are commonly used for holding together sheets of paper are of at least three types. The simplest is the lever or crowbar type, consisting of a shank ending in a wedge tip which can be pushed under the crown of a clinched staple. The legs of the staple are usually pulled out of the document by either continuing this pushing movement, to lift the staple by a wedging action, or pivoting the shank about the tip to use the document as a fulcrum to lift the staple, like a crowbar. See, e.g., U.S. Pat. Nos. 4,473,220 and 5,088,692. However, if one leg of the staple pulls clear of the document before the other leg, further movement of such removers tends merely to deform the staple without lifting the other, retained, leg out of the paper, so that final removal of the staple from the document has to be effected manually, to the possible detriment of the user's fingers, and with a risk of damaging the paper.

Another well known staple remover is of the pincers or tweezers type, as exemplified in U.S. Pat. No. 4,903,945, in which two pairs of tapered sheet metal jaws acting as wedges are both inserted, from opposite directions between the crown of the clinched staple and the stapled document. As the jaws are pushed towards each other, they exert a lifting force on the crown in the direction substantially normal to the document surface. This force is normally sufficient to pull the bent-over legs of the staple back through the document, partially straightening them in the process, but with a risk of damaging the document. (The two pairs of teeth may be first inserted under the clinched staple legs, on the opposite side of the document, to partially straighten the clinched legs first.)

Surgical staples, which are usually clinched into a C-shape, of which the leg ends face each other and hold the edges of two portions of skin in contact with each other until they become knitted together by the body's healing mechanisms, can be removed by means of a device such as is disclosed in GB 2 176 434 A or U.S. Pat. No. 4,026,520. This latter staple remover consists of a pliers-type device of which one 'jaw' consists of a pair of so-called 'anvils' of sheet metal which extend first in parallel with each other and then converge into contact with each other so that they do not stab into the healed wound when being positioned below the crown of the surgical staple. The other 'jaw' consists of a blunt 'blade' of single thickness metal which, when the pliers are moved towards their closed position, contacts the center of the crown and distorts it into a U-shape to cause the ends of the legs to be pulled out of the skin. The '520 surgical staple remover is not intended to remove office document staples, and clinched office staples are of a different configuration than surgical staples. The above-cited U.S. Pat. No. 4,903,945 in e.g., FIG. 7 thereof, also shows central deformation of the staple crown, for staple removal from documents.

There is disclosed in the embodiments herein, among other features, a staple remover for extracting a conventional clinched office staple from a stapled set of paper sheets, wherein the clinched staple has a central staple crown portion and two opposing clinched staple legs extending with arcuate bends from the opposite ends of the crown portion through staple holes through the paper sheets made by the two staple legs during stapling, comprising a first member including two spaced apart prongs adapted to be inserted between the crown of the staple and the stapled set of paper sheets, and a second member mounted for movement relative to said first member, said second member including a nose member mounted for movement between and closely adjacent to but spaced from said two spaced prongs upon said relative movement between said first and second members, said nose member being adapted, upon said relative movement between said first and second members, to apply staple deformation forces at two spaced apart positions adjacent to the opposite ends of the crown of the staple and adjacent to the clinched staple legs and adjacent to said two spaced prongs, to cause the ends of the crown adjacent the two clinched staple legs to be substantially deformed without substantial deformation of the central portion of the crown of the staple, so as to allow the two staple legs to be withdrawn substantially through the staple holes in the paper sheets.

Further features disclosed in the embodiments, individually or in combination, include two separate and spaced apart nose portions for respectively applying said forces at said two spaced apart positions so as to deform each end of the crown between one said nose portion and one said prong; and/or wherein said two separate spaced apart portions of said nose member are respectively maintained adjacent to but slightly spaced from said two prongs of said first member upon said relative movement between said first and second members; and/or wherein said nose member comprises a single member only slightly narrower than the crown portion of the staple to be removed and said space between said prongs, and said nose member is shaped to maintain the central portion of said staple crown substantially undeformed upon said relative movement between said first and second members; and/or wherein said prongs extend substantially parallel to one another, and the outer surfaces of said prongs are spaced apart by a distance slightly less than the length of the crown of the staple to be removed; and/or wherein said two prongs outwardly converge towards one other, and wherein said nose member has outer surfaces which converge substantially in parallel with said converging prongs; and/or wherein said prongs each have a substantially parallel-sided end portion tapering to a tip end forming a wedge and/or wherein said second member is pivotally mounted to said first member; and/or further including a third member, pivotally mounted on said first member, and linked to said second member so as to provide a mechanical advantage for said staple deformation forces applied by said nose member when said second member is moved relative to said first member; and/or wherein said two members comprise a pair of levers pivotally connected together in a pliers-like configuration with long and short lever ends, one said lever terminating at said shorter end thereof in said pair of prongs, and the other said lever having said shorter end terminating in said nose member, and wherein said nose member is movable between an open position in which said nose member is spaced from both said prongs by a distance greater than the thickness of the staple crown, and a closed position in which at least a portion of said nose member is spaced inside of and between said prongs with sufficient clearance to accommodate two separate substantial portions of the staple respectively between opposite sides of said nose member and the insides of said prongs; and/or wherein said prongs extend beyond said nose member; and/or wherein said nose member is adapted to grip the deformed staple between said two members so that both staple legs may be lifted clear of the document with said staple remover after said relative movement; and/or a staple remover comprising a first member providing a pair of prongs to be inserted between the outer ends of the crown of a clinched staple and a document clinched by that staple, and a second member mounted to be cooperatively pressed into the outer ends of the opposing side of the staple crown from said prongs, closely laterally spaced from said prongs, so as to at least partially deform the ends of the staple crown in a manner which pulls the legs of the staple back through the holes in the document made when the document was stapled.

The various advantages of the disclosed staple removers include: removing the clinched legs by moving them substantially along their original length, so as to leave the document through virtually the same holes which the staple legs made when being inserted into the document; then holding the staple crown firmly, so that the staple may be removed in one step; not deforming the central, and major, portion of the staple crown; and the ability of the staple remover to be operated one-handed.

Various exemplary embodiments of the present invention will now be described by way of examples with reference to the accompanying drawings, which are substantially to scale, in which.

Figure 1:
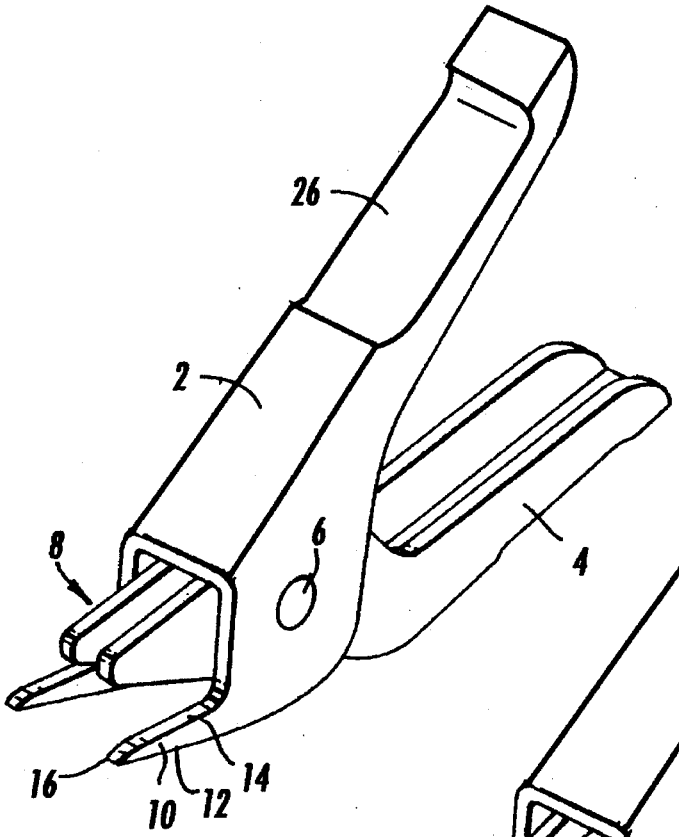
FIG. 1 is a perspective view of one embodiment of staple remover in accordance with the present invention.
Figure 2:
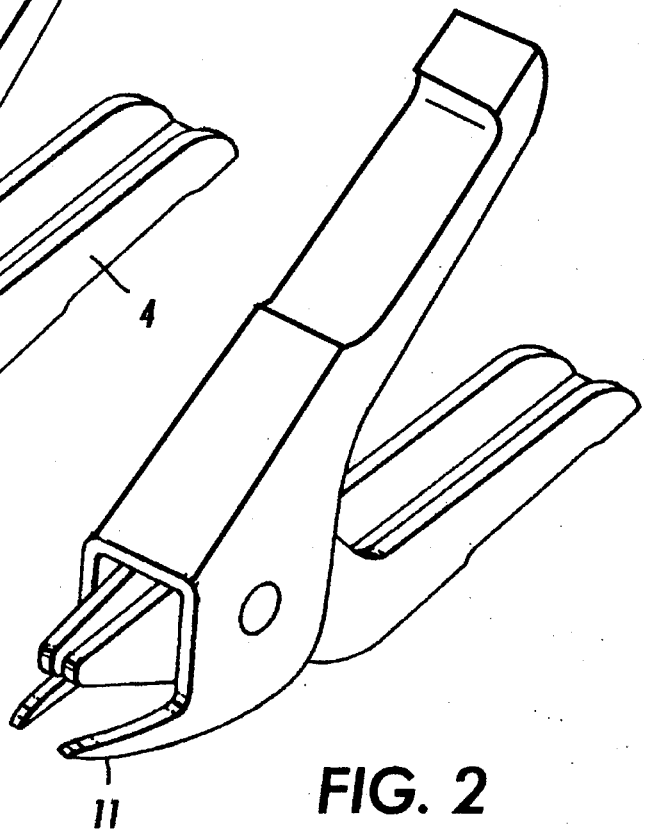
FIG. 2 is a view similar to FIG. 1 of a second embodiment of the invention.
Figure 3A:
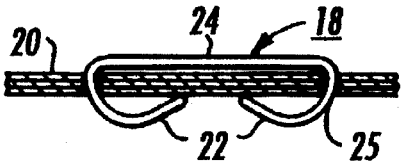
Figure 3B:
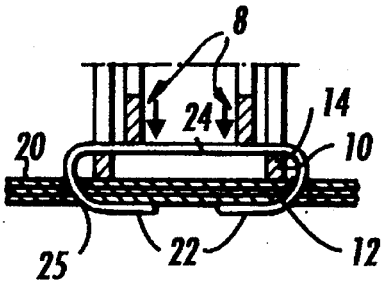
Figure 3C:
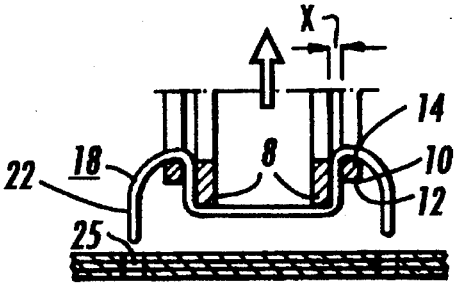
Figure 4A:
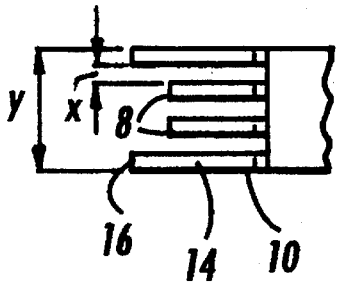
Figure 4B:
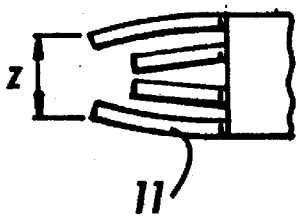
Figure 5A:
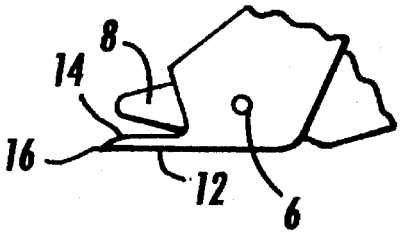
Figure 5B:
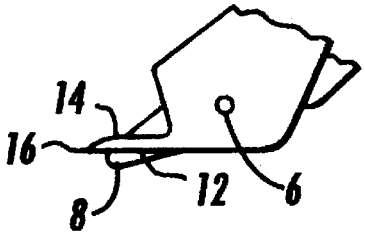
Figure 6:
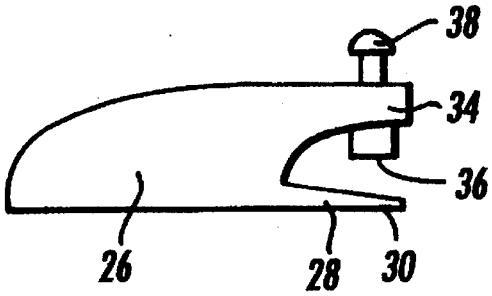
Figure 7:
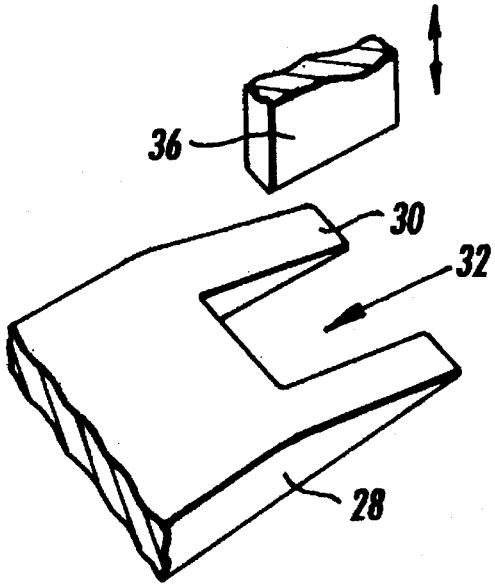
Figure 8:
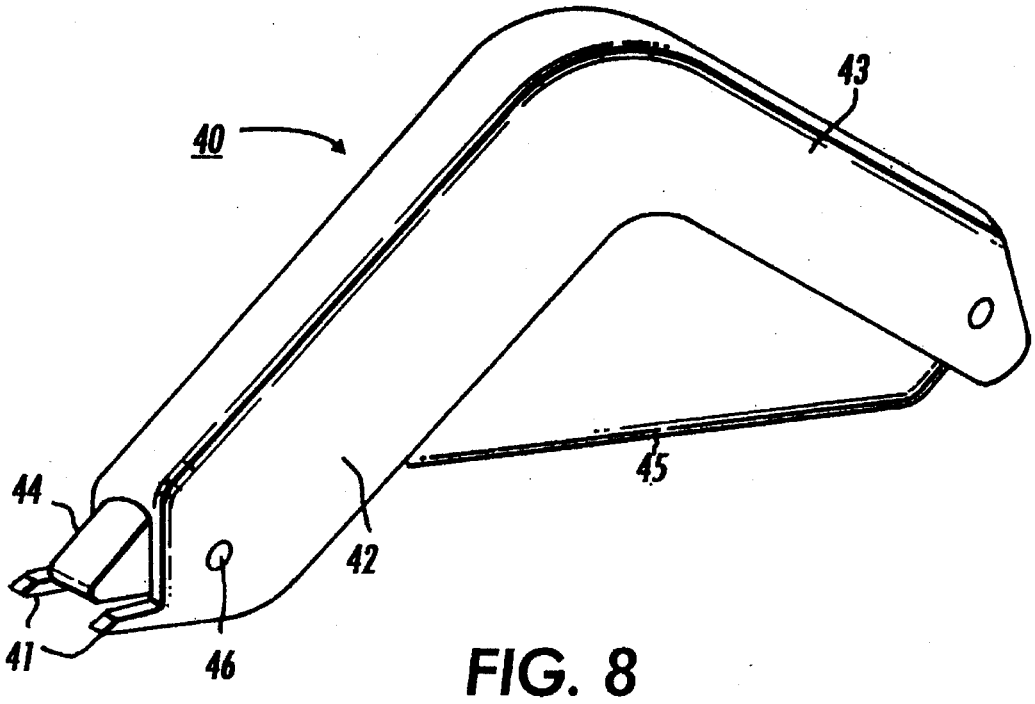
Figure 9:
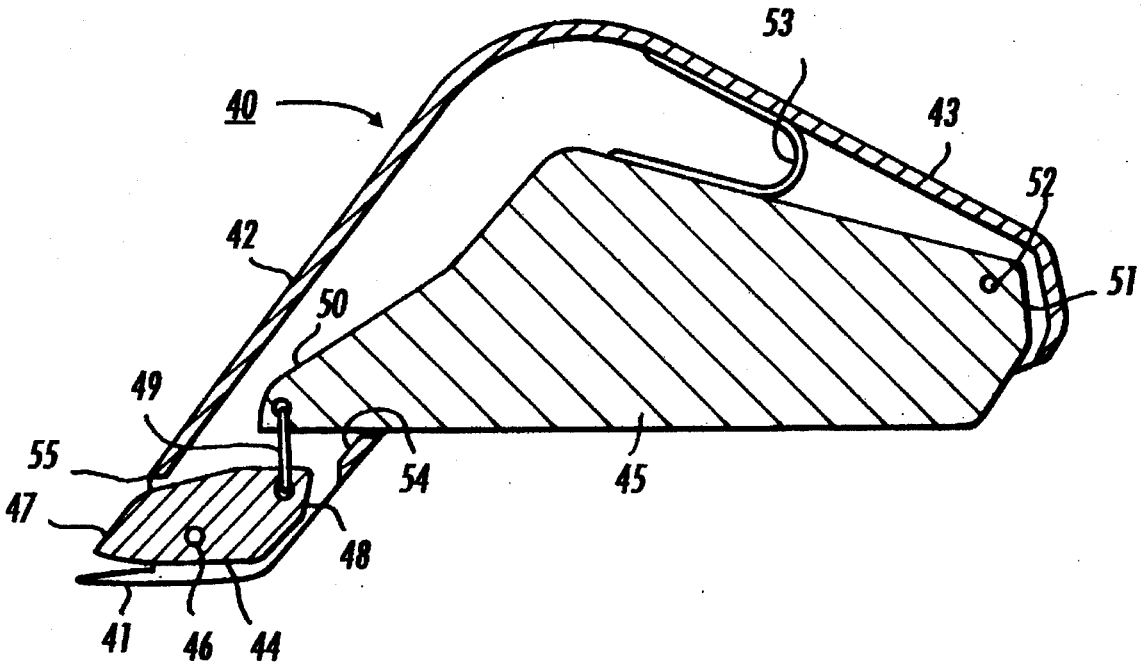

FIGS. 3*a*, 3*b*, and 3*c* show three different diagrammatic end elevations, on an enlarged scale, illustrating the mode of operation of the FIG. 1 disclosed staple remover on a staple being removed from a set of stapled sheets in cross-section;

FIGS. 4*a* and 4*b* show partial plan views of the working ends of the staple removers of FIGS. 1 and 2, respectively, to show the different shapes of their jaws;

FIGS. 5*a* and 5*b* are partial side views of both said FIG. 1 and FIG. 2 embodiments of staple removers, respectively showing their jaws in their fully-opened and fully-closed positions;

FIG. 6 is a diagrammatic side view of another embodiment, in the general form of an office stapler;

FIG. 7 is a perspective enlarged view of part of the FIG. 6 device, showing its working parts more clearly;

FIG. 8 is a perspective view of a further staple remover embodiment;

FIG. 9 is a cross-sectional side view of the FIG. 8 device; and

Figure 10:
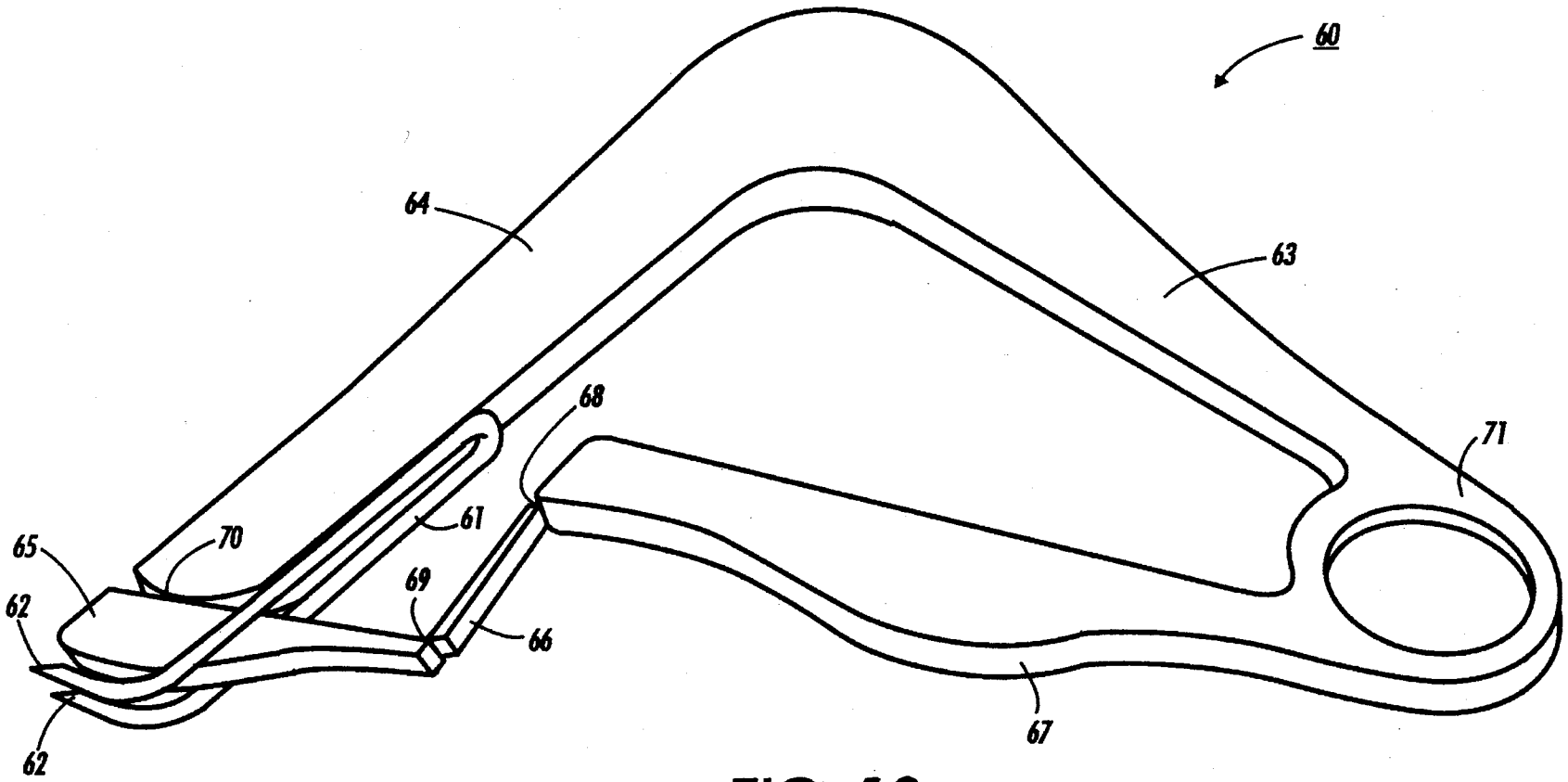

FIG. 10 is a perspective view of a further embodiment of the invention.

The illustrated staple removers are intended to be used to remove conventional clinched office staples of the kind used for stapling sheets of paper together. Referring first to FIGS. 1, 3, and 4, such staples have crowns which are typically about 12 mm long, although there are other standard sizes, as will be discussed. The FIG. 1 staple remover consists of two members, levers 2 and 4, pivotally connected together by a pivot pin 6. Each of the levers may be made from a single piece of shaped metal which has been folded along two parallel lines so that it is substantially of square U-shape in transverse cross-section. The two fold lines are different distances apart, so that lever 4 is nested within lever 2, and so that the outer parallel surfaces of the inner lever 4 are in sliding contact with the inner surfaces of the parallel portions of the outer lever 2 to act as a bearing defining the planes in which the two levers 2 and 4 are able to move relative to each other.

As can be seen from FIGS. 1 and 4*a*, the respective ends of the inner lever 4 cooperate with each other to form a "nose" member 8, the function of which will be described in more detail below. The shorter or leveraged ends of the inner lever 4 forming nose 8 are cranked inwardly so that the planes in which the outer surfaces of these ends move are spaced inwardly by a distance 'x' (see FIG. 4*a*) from the planes of the inner surfaces of the (shorter) ends of the outer lever 2. These shorter ends of the outer lever 2 are formed into two parallel spaced prongs 10.

As shown in FIG. 5, the bottom surfaces 12 of the pair of prongs 10 lie in a plane, and these bottom surfaces are intended to be pressed into contact with the upper staple (crown side) surface of a stack of paper sheets conventionally held together by a clinched staple, as shown in FIG. 3*a*. The upper surface 14 of each prong 10 may initially extend out in parallel with bottom surface 12 (the base of the prong), but it then tapers smoothly down to form a relatively sharp wedge-shaped end or tip 16. The outer surfaces of the tip 16 of the prongs 10 are desirably spaced apart by a distance 'y' in FIG. 4*a* which is slightly less than a standard staple crown length, e.g., 12 mm, in FIG. 1 embodiment.

The embodiment of FIG. 2 is otherwise similar, and its prongs 11 are of substantially the same shape in elevation as the prongs 10 of FIG. 1. However, in plan view, as shown diagrammatically in FIG. 4*b*, the prongs 11 of this second embodiment curve towards each other so that they terminate with their tips spaced apart by a distance 'z' which is less than the length of the crown of the smallest staple the remover is intended to remove. However, at their widest (starting) point, the prongs 11 of the FIG. 2 embodiment are spaced apart by the same dimension "y" as the FIG. 1 embodiment, so that both embodiments may be made from sheet metal blanks of the same shape, the only difference being that the levers 2 and 4 are subjected to additional operations to shape the prongs 11 and the nose. As also shown in FIG. 4*b*, the two front parts of the inner lever which form the nose 8 in FIG. 1 are also caused to converge towards each other in the second embodiment of FIG. 2. It is unnecessary for them to be bent into the shape of a curve. It is sufficient if they remain spaced from the inner surface of the curved prongs 11 by a distance which is not less than the dimension 'x' of FIG. 4*a*, which is related in turn to the maximum thickness of the metal strip forming the staple which is engaged therebetween, as will be explained.

As shown clearly in FIG. 5, the distance from the axis of pivot pin 6 to the end of nose 8 is less than the distance from the same axis to the tip 16. That is, the prongs 10 or 11 extend outwardly beyond the nose 8. Thus, the remover may be inserted with the prongs 10 or 11 below the crown of a clinched staple in an initial insertion position in which the upper surface of the crown is not contacted by the nose. This remover is thus inserted under the crown of the staple for a minimum distance before this remover is operated. Although not essential, it is preferred to ensure that the staple crown is resting on the parallel portion of the prongs on their surfaces 14 before the staple is also contacted by the nose 8 by the levers 2 and/or 4 being moved from their fully-opened position shown in FIG. 5*a* to the fully-closed position shown in FIG. 5*b*.

The operation of the disclosed staple removers will now be described in more detail with particular reference to FIG. 3. FIG. 3*a* shows diagrammatically a conventional clinched office staple 18 holding together a document 20 formed from three sheets of paper or other such print medium. As is well known, the staple 18 has reached the position shown in FIG. 3*a* by starting in a position in which its legs 22 initially extend in parallel with each other and at right angles to their connecting crown 24. The end of each staple leg 22 is usually beveled or otherwise formed to act as a chisel point to assist its penetration into the document 20 as force is applied to the staple crown 24 in line with the legs 22. As the parallel legs 22 are being pushed through the paper by a stapler, their protruding ends are usually engaged by an opposing stationary die plate or clincher (not shown) which forces the ends of the legs 22 to follow two inwardly curved paths until they reach the fully clinched position shown in FIG. 3*a*, in which the ends of the legs 22 contact the back surface of the document stack 20 to help hold it together.

When the document is to be unclinched or destapled, the subject staple remover has its prongs 10 or 11 pushed between the staple crown 24 and document 20, or the stapled document is pulled past the prongs to so engage. In so doing, the crown 24 ends of the clinched legs 22 are partially lifted into a position such as is shown in FIG. 3*b*, by reason of the wedging action lifting force applied to the staple crown by the prongs 10. When the prongs have been sufficiently inserted, so that the nose 8 is overlying the crown 24, the levers 2 and 4 may be squeezed together, to move the nose towards and then in between the prongs, to the position shown in FIGS. 3*c* and 5*b*. In closing the staple remover mechanism to this position, it may be seen that the staple is deformed and forced into following a somewhat serpentine path. A portion of the length of the staple comes to rest in the vertical space between each prong 10 and the adjacent surface of nose 8. It is this space which has the dimension 'x' shown in FIG. 4*a*. In the application of these forces to the staple the outer 'corners' of the nose act as fulcra. As the nose moves parallel relative to the prongs it causes these two respective parts of the staple at the ends of the crown to bend about the fulcra. Because of the generally arcuate shape of the affected upper portions of the clinched legs, that causes the curved leg ends of the staple to travel substantially along the arc, i.e., to open or unclinch, as shown in FIG. 3*c*. This allows the leg ends to be removed from the document back through the entry holes 25 which the staple made when it was being stapled to the document. In this way, extraction of the ends of the legs 22 involves very little, if any, further tearing of the edges of the holes 25 formed in the document.

It will be appreciated that the holes 25 are not actually as illustratively shown in FIG. 3, because no material is removed from the document when a staple is inserted. What happens is that the staple legs punch holes through the paper by selective tearing and displacement of the paper or other material forming the document. When the staple has been removed as described herein, although the tears 25 remain, the document becomes relatively smooth to the touch, as the displaced material tends to fill up the two tear spaces left as the staple legs are removed.

Although FIG. 3 shows the prongs 10 being spaced (by distance 'x') from the nose member 8 by a distance which is just greater than the thickness of the staple, so that the staple bears against the sides of the nose as the nose and prongs move to their fully-closed position, it is also possible for the distance 'x' to be greater than the thickness of the staple so that the crown 24 is distorted into the shape of a shallow curve rather than into a square U-shape maintaining a linear central crown, as shown in FIG. 3*c*. What is important in this embodiment is that the prongs 10 are spaced apart by a distance slightly less than the straight length of the crown, so that they provide mechanical support to the crown at a location closely adjacent to the legs and therefore closely adjacent to the holes 25 made by the staple. Thus the prongs also provide firm mechanical support for the document desired positions because, as the staple is lifted from the fully clinched position of FIG. 3*a*, that portion of the document bears on the inside surface of the legs 22 with sufficient force to cause them to become less curved, as they are deformed to the position of Fig. 3*b*.

The modus operandi of the FIG. 2 embodiment is basically the same as that of FIG. 1. The FIG. 2 embodiment is designed to be able to remove a wider range of staples, of different crown sizes. Thus, for instance, the curved prongs 11 of the FIG. 2 embodiment at their narrower end can be inserted below the crown of a clinched 7 mm staple, the remover being able to be pushed into a position in which the crown lies under the end of the nose, permitting such a smaller staple to be removed as described above. For staples of larger size, the remover is pushed in further under the staple to a position in which the surfaces 14 of the prongs come into contact with the ends of that larger length of the crown, so that the remover functions as previously described. However, in all the range of sizes on which the FIG. 2 remover can operate, the varying distance between the curved nose and the curved inner surfaces of the prongs (shown in FIG. 4*b*) is always greater than the thickness of the staple, for reasons already discussed above in connection with FIG. 3*c*.

Although not shown, it will be understood that the remover could be conventionally spring biased to the fully-open position shown in FIGS. 1, 2, and 5*a*, such as by by means of a helical spring through which the pivot pin 6 extends, with the ends of the spring engaging seats integral with the levers 2 and 4, so that the spring acts as a torsion spring of which the force has to be overcome by the user when pressing the remover to the fully-closed position.

It will be appreciated that in the fully closed position, as in FIG. 3*c* and FIG. 5*b*, the staple is gripped sufficiently tightly between the nose and the prongs for the leg ends to be pulled clear of the document and held with very little, if any, further manipulation of the remover, so that the staple is removed positively, and also held until released.

Because of the forces involved, it is envisaged that the levers 2 and 4 would be conventionally made from bent sheet metal. However, it might be that plastics or other materials could be used which could be conventionally formed into the effective shape of the staple remover or parts thereof, as by injection molding, and still possess the necessary mechanical strength and wear resistance. In either case, it may be seen that this is a simple to manufacture and low cost apparatus.

Although the ends of the levers 2 and 4 to be gripped by the user are shown as being formed with hand grip area such as 26 in FIG. 1, these could be serrated to improve the grip, or even provided with 'wings' of plastics material (not shown) offering larger area gripping surfaces to the user so that he or she is able to push the prongs of the remover below a clenched staple, and then squeeze the levers together to operate the remover, with relatively little effort.

The different embodiment shown in FIGS. 6 and 7 uses a free standing base 26 similar to a stapler, but having a foot 28 with two forwardly projecting prongs 30 basically in the form of two flat wedges having a substantially rectangular space 32 between them. The base 26 is formed with a holder 34 for a vertically movable bar 36 of which the lower end acts as the wide nose of other embodiments. The bar 36 is spring biased upwards, terminating in a pusher 38 by which the bar can be driven downwards when a staple is to be removed. The prongs 30 are first pushed under the crown of a clinched staple, starting the extraction process. The bar 36 is then depressed until it comes into contact with, and deforms, the crown. In so doing, the curved legs of the staple are pivoted about the crown ends, as already described, to pull them out of the paper or other stapled media with virtually no further damage to the sheets. The bar 36 may hold the distorted staple in place on the prongs 30 until after the staple has been completely removed from the sheets, after which the bar 36 may be released to permit the staple to be dropped into a wastepaper basket or other receptacle for disposal.

The FIG. 6 or other embodiments herein may easily be electrically solenoid operated or cam driven mechanically. E.g., a conventional solenoid pushing pusher 38 in FIG. 6, or arm 4 in FIG. 1, etc..

Additionally or alternatively, the subject staple remover can be integral or flush mounted upside down to a work surface of a copier, document scanner or the like, as in the above-cited U.S. Pat. No. 4,473,220, preferably with an associated collection box for the removed staples, incorporated by reference herein.

Referring now to FIGS. 8 and 9, there is shown a further embodiment, in which a body member 40 carrying the prongs 41 is of generally L-shaped configuration with a forward, support, portion 42 and a rearward, downwardly inclined, handle portion 43. The body member 40 is of U-shaped cross section, being hollow and open downwardly. Within the body member 40 are accommodated a second, nose member, 44 and a connecting third, trigger member, 45. The nose member 44 is pivotally mounted in the support portion 42 of the body member 40 by means of a pivot pin 46. The nose member 44 comprises a nose portion 47 and a lever portion 48, disposed respectively in front of, and behind, the pivot pin 46. The lever portion 48 of nose member 44 is linked by a link arm 49 to the forward end 50 of trigger member 45. The rear end 51 of trigger member 45 is pivotally mounted in the handle portion 43 of body member 40 by means of a pivot pin 52. The link arm 49 has bent-over portions at its two ends which provide pivotal connections respectively to the nose member 44 and trigger member 45. A leaf spring 53 is mounted between the upper surface of trigger member 45 and the inside surface of body member 40 and urges the trigger member 45 downwards. A shoulder 54 is provided on one or both of the inside lower edges of the forward portion 42 to limit the downward movement of trigger member 45. Alternatively, or in addition, a shoulder 55 may be provided just above the front of the nose member 44.

In the operation of this embodiment of FIGS. 8 and 9, the handle portion 43 of the device is gripped by the hand of the user, and the trigger member 45 is pulled upwardly by a natural gripping or squeezing action. The resulting lifting of the forward end 50 of the trigger member causes the lever portion 48 of the nose member 44 to lift, thereby driving, with good mechanical advantage, the nose portion 47 downwards between the prongs 41. This device thus operates to extract staples in the same way as the other embodiments described above. The advantages of this embodiment include the fact that it can conveniently be rested on a stapled document on a flat surface, and the prongs 41 then inserted under the crown of the staple by pushing or sliding towards the staple. The hand can extend generally horizontally towards the device, and grip the trigger member with the wrist in a neutral position. This gives ergonomic advantages, and enables considerable force to be applied to a staple without awkwardness or discomfort to the user. Alternatively, a stack of sheets can be held in one hand, and the remover in the other. Once the prongs have been inserted between the staple crown and the top sheet, the trigger member 45 may be simply squeezed to remove the staple.

A further embodiment of the invention is shown in FIG. 10 which consists of only two parts; a body 60 and a prongs member 61. The prongs member 61 may be in the form of a generally U-shaped member, preferably of metal such as hard steel, with its two ends bent to an appropriate angle to form prongs 62. The prongs 62 are tapered towards their extremities to enable them to be inserted under the crown of a staple. The prongs member 61 may be secured to the body 60 by any suitable means, but for simplicity may be a snap fit over a suitably shaped retaining member formed on the body 60. The body 60 may conveniently be formed as a single injection moulding of polypropylene or other plastics material, and consists of a handle portion 63, a support portion 64, a nose 65, a connecting link 66, and a trigger portion 67. Integral molded-in thin area hinges ("living hinges") are formed between various parts of the body 60, as follows. A first hinge 68 is formed between the front end of trigger portion 67 and the upper end of the link 66, a second hinge 69 is formed between the lower end of the link 66 and the rear end of nose 65, and a third hinge 70 is formed between the top of nose 65 and the lower end of support portion 64. The rear end of the trigger portion 67 is connected by a ring 71 to the rear end of the handle portion 63.

In operation of the FIG. 10 embodiment, pressure is applied by squeezing the trigger portion 67 towards the handle portion 63, taking advantage of the resilience of the trigger portion 67 to allow it to move upwards. This pulls up the rear end of the nose 65 via link 66, causing the front of the nose to move down between the prongs 62, by virtue of its pivotting about the hinge 70. If the prongs 62 have been inserted under the crown of a staple, the downward movement of the nose causes the staple legs to be withdrawn in the same manner as the other embodiments described above.

Although the embodiments of FIGS. 1 and 2 are shown and described with a nose comprising two spaced apart members, these embodiments could equally well use a solid nose, as in other embodiments here. Conversely, the embodiments of FIGS. 6, 7, 8, 9, and 10 can use spaced apart members for the nose, rather than the solid member shown and described. In either case, it is desired that forces are applied to the staple crown at locations sufficiently near the crown ends of the legs of the staple to cause extraction of the staple legs from the stapled sheets by rotation about the points at which the forces are applied. This ensures that the legs are extracted substantially through the staple holes made by the staple legs during insertion of the staple.

In the case where such a solid nose is used, it may have a generally rectangular cross section, i.e. in cross section it may have parallel side walls and a flat base portion perpendicular to the side walls. A flat nose base will hold the crown central portion flat. Alternatively, the base portion of the nose may be of any suitable configuration which will apply the forces at two spaced apart locations to a given type or size of staple. Thus, for example, the base portion may be curved, concave downwards, or of a more complex shape.

Accordingly it can be seen that the present invention provides a staple remover of simple mechanical construction which is easy to operate and which removes clinched staples with very little, if any, additional damage to the stapled document and has other important advantages, including alternative configurations and operations.

While the embodiments disclosed herein are preferred, it will be appreciated from this teaching that various alternatives, modifications, variations or improvements therein may be made by those skilled in the art, which are intended to be encompassed by the following claims:

What is claimed is:

1. A staple remover for extracting a conventional clinched office staple from a stapled set of paper sheets, wherein the clinched staple has a central staple crown portion and two opposing clinched staple legs extending with arcuate bends from the opposite ends of the crown portion through staple holes through the paper sheets made by the two staple legs during stapling, comprising: a first member including two spaced apart prongs adapted to be inserted between the crown of the staple and the stapled set of paper sheets, and a second member mounted for movement relative to said first member, said second member including a nose member mounted for movement between and closely adjacent to but spaced from said two spaced prongs upon said relative movement between said first and second members, said nose member being adapted, upon said prongs insertion and said relative movement between said first and second members, to apply staple deformation forces at two spaced apart positions adjacent to the opposite ends of the crown of the staple, at the opposite side of the crown from said prongs, adjacent to the clinched staple legs and adjacent to said two spaced prongs, to cause the ends of the crown adjacent the two clinched staple legs to be substantially deformed without substantial deformation of the central portion of the crown of the staple, so as to allow the two staple legs to be withdrawn substantially through the staple holes in the paper sheets;

wherein said nose member comprises two separate and spaced apart nose portions for respectively applying said forces at said two spaced apart positions so as to deform each said end of the crown between one said nose portion and one said prong;

wherein said two separate spaced apart portions of said nose member are respectively maintained adjacent to but slightly spaced from said two prongs of said first member upon said relative movement between said first and second members.

2. The staple remover of claim 1, wherein said prongs extend substantially parallel to one another, and the outer surfaces of said prongs are spaced apart by a distance slightly less than the length of the crown of the staple to be removed.

3. The staple remover of claim 1, wherein said two prongs outwardly converge towards one other, and wherein said nose member has outer surfaces which converge substantially in parallel with said converging prongs.

4. The staple remover of claim 1, wherein said prongs each have a substantially parallel-sided end portion tapering to a tip end forming a wedge.

5. The staple remover of claim 1, wherein said second member is pivotally mounted to said first member.

6. The staple remover of claim 1, wherein said two members comprise a pair of levers pivotally connected together in a pliers-like configuration with long and short lever ends, one said lever terminating at said shorter end thereof in said pair of prongs, and the other said lever having said shorter end terminating in said nose member, and wherein said nose member is movable between an open position in which said nose member is spaced from both said prongs by a distance greater than the thickness of the staple crown, and a closed position in which at least a portion of said nose member is spaced inside of and between said prongs with sufficient clearance to accommodate two separate substantial portions of the staple respectively between opposite sides of said nose member and the insides of said prongs.

7. The staple remover of claim 1, wherein said prongs extend beyond said nose member.

8. The staple remover of claim 1, wherein said nose member is adapted to grip the deformed staple between said two members so that both staple legs may be lifted clear of the document with said staple remover after said relative movement.

9. The staple remover of claim 1 wherein said two separate spaced apart portions of said nose member are laterally spaced respectively from said two prongs of said first member during said relative movement between said first and second members by a sufficently close lateral spacing to sharply bend said ends of said staple crown in a manner which pulls said staple legs back out through said staple holes through said paper sheets.

10. A staple remover for extracting a conventional clinched office staple from a stapled set of paper sheets, wherein the clinched staple has a central staple crown portion and two opposing clinched staple legs extending with arcuate bends from the opposite ends of the crown portion through staple holes through the paper sheets made by the two staple legs during stapling, comprising: a first member including two spaced apart prongs adapted to be inserted between the crown of the staple and the stapled set of paper sheets, and a second member mounted for movement relative to said first member, said second member including a nose member mounted for movement between and closely adjacent to but spaced from said two spaced prongs upon said relative movement between said first and second members, said nose member being adapted, upon said prongs insertion and said relative movement between said first and second members to apply staple deformation forces at two spaced apart positions adjacent to the opposite ends of the crown of the staple, at the opposite side of the crown from said prongs, adjacent to the clinched staple legs and adjacent to said two spaced prongs, to cause the ends of the crown adjacent the two clinched staple legs to be substantially deformed without substantial deformation of the central portion of the crown of the staple, said nose member having two widely spaced apart side wall portions with an outside width only slightly less than the inside spacing between said two spaced prongs during said relative movement, said side wall portions being closely spaced from the insides of said spaced prongs during said relative movement by a distance only slightly greater than the dimension of said staple legs to hold said staple legs between the insides of said spaced prongs and said side wall portions of said nose member during said relative movement, and said two widely spaced apart side wall portions of said nose member being positioned and adapted to operatively engage and sharply bend both of said opposite ends of said crown portion of said staple and pull said staple legs through said close spacing between said side wall portions of said nose member and said prongs during said relative movement to pull said staple legs back out through said staple holes through said paper sheets.

* * * * *